US009744433B2

(12) United States Patent
Baldauf et al.

(10) Patent No.: US 9,744,433 B2
(45) Date of Patent: Aug. 29, 2017

(54) SKATEBOARD TRUCK WITH ADJUSTABLE PIVOT POINT

(71) Applicants: Thomas Baldauf, Merrick, NY (US); Kurt Baldauf, Merrick, NY (US)

(72) Inventors: Thomas Baldauf, Merrick, NY (US); Kurt Baldauf, Merrick, NY (US)

( * ) Notice: Subject to any disclaimer, the term of this patent is extended or adjusted under 35 U.S.C. 154(b) by 0 days.

(21) Appl. No.: 15/344,291

(22) Filed: Nov. 4, 2016

(65) Prior Publication Data

US 2017/0072290 A1 Mar. 16, 2017

Related U.S. Application Data

(63) Continuation of application No. 14/621,372, filed on Feb. 12, 2015, now Pat. No. 9,498,701.

(60) Provisional application No. 61/939,058, filed on Feb. 12, 2014.

(51) Int. Cl.

| | |
|---|---|
| ***A63C 17/12*** | (2006.01) |
| ***A63C 17/00*** | (2006.01) |
| ***A63C 17/01*** | (2006.01) |

(52) U.S. Cl.
CPC ..... *A63C 17/0093* (2013.01); *A63C 17/012* (2013.01); *A63C 17/013* (2013.01); *A63C 17/015* (2013.01); *A63C 17/017* (2013.01)

(58) Field of Classification Search
None
See application file for complete search history.

(56) References Cited

U.S. PATENT DOCUMENTS

2013/0175774 A1* 7/2013 Lininger, Jr. ..... A63C 17/0033 280/11.27

* cited by examiner

*Primary Examiner* — Bryan Evans
(74) *Attorney, Agent, or Firm* — Attentive Law Group, PLLC; Paul L. Ratcliffe

(57) ABSTRACT

The present invention relates to a novel skateboard truck. More particularly, the present invention pertains to skateboard truck with two independently adjustable pivot points that achieve a unique variable turning motion without affecting the skateboard's stability. Additionally, the skateboard truck includes an offset axle that swings towards the direction of the turn, thus shifting the wheels away from the side of the skateboard, eliminating wheel bite, and increasing stability.

8 Claims, 7 Drawing Sheets

SKATEBOARD TRUCK WITH ADJUSTABLE PIVOT POINT

RELATED APPLICATION

This application claims priority to U.S. patent application Ser. No. 14/621,372 filed on Feb. 12, 2015 entitled "Skateboard Truck with Adjustable Pivot Point", which claims priority to U.S. Provisional Patent Application 61/939,058 filed on Feb. 12, 2014, entitled "Skateboard Truck with Adjustable Pivot Point", the entirety of both are incorporated herein.

BACKGROUND OF THE INVENTION

1. Field of the Invention

The present invention relates to an improved skateboard and skateboard truck. More particularly, the present invention pertains to skateboard truck with two independent pivot points, one fixed pivot point and one adjustable pivot point, which provide a variable turning capability without affecting the skateboard's stability.

2. Description of the Related Art

Conventional skateboards include an elongated board (i.e., deck) with two steering mechanisms (i.e., trucks) that are attached to the underside of the deck. A steering mechanism or truck usually consists of a base plate, bushings, a hangar or axle, and wheels. The base plates are attached to the underside of the board and have a king pin bolt and a pivot cup. The hangar has an extended tip which mates with the pivot cup of the base plate and creates the pivot point. The hangar also has a circular opening which is mounted on the king pin along with a top and bottom bushing. The bushings and hangar circular opening are held onto the king pin bolt by a lock nut which is screwed onto the open end of king pin bolt. The strength of the bushings and the level the lock nut is tightened determine the range the hangar can move or flex. The hangar also has an axle running through the long part of the hangar. The wheels are attached to the axles and held on to the axles by lock nuts. Standard skateboards have two trucks mounted or attached on the underside and at the front and back of the deck. The axis of each truck or axle is typically attached perpendicular to the longitudinal axis of the deck.

In order to steer the skateboard in a certain direction, the rider shifts their weight laterally across the longitudinal axis of the board causing the hangar to flex within the bushings and pivot cup mechanism to change the orientation of the truck axle with respect to the longitudinal axis of skateboard deck. The truck also serves as a suspension system that provides stability while the rider turns the skateboard. However, by stabilizing the board by tightening the king pin lock nut or by using harder bushings, the skateboard sacrifices its turning ability.

Skateboards and skateboard trucks have been made the same way for many years. However, what is needed is a way to create flexible turning on skateboards while maintaining stability.

SUMMARY OF THE INVENTION

This summary is provided to introduce concepts in a simplified form that are further described in the detailed description of the invention. This summary is not intended to identify key or essential inventive concepts of the claimed subject.

The present invention overcomes the limitations of known skateboard trucks by providing a skateboard truck with two independently operating pivot points that achieve a variable turning motion without affecting the skateboard's stability. Specifically, the present invention provides a truck with a variable turning radius which may be adjusted or modified by changing the horizontal and vertical distance between the first pivot point of the axle assembly and the adjustable secondary pivot point. By including an adjustable secondary pivot point to the truck, the skateboard is able to make tighter turns with less tilt from the rider. This is accomplished by adjusting the amount of turning angle relative to the degree of the board. Stated alternatively, if the skateboard was held at a constant angle of tilt, one could alter the turning radius of the skateboard by moving the adjustable secondary pivot point. By adjusting the second pivot point, the geometry of the truck has changed thereby changing the turning ratio or angle of turn of the skateboard even though the skateboard angle of tilt was held constant.

Adjusting the turning ratio is completely independent from the adjustment for board stability. Board stability in the present invention is achieved by rubber pads which are located on either side of the first pivot point, as well as a thin adjustable urethane pad positioned between the base plate and the bottom surface of the first pivot hub. By tightening the screws and driving the pad further into the decreasing space under the first pivot hub, stability is increased. The dual pivot point adjustment options of the present invention give users or skateboarders the ability to completely customize the ride of the skateboard to his or her preference.

The present invention also includes a unique offset axle. The offset of the axle from the pivot point swings or moves the axle towards the direction of the turn, thus shifting the wheels away from the side of the skateboard and eliminating or reducing wheel bite. The offset axle also provides additional stability when steering the skateboard by shifting the center of gravity towards the direction of the turn. This center of gravity shift is achieved by moving the entire axle toward the turn. As the rider shifts his weight laterally across the board, the rider's center of gravity also moves in the direction of the turn, thus keeping the center of gravity of the truck consistently under the rider giving him much more stability during a turn.

These and other objects, features, and/or advantages may accrue from various aspects of embodiments of the present invention, as described in more detail below.

BRIEF DESCRIPTION OF THE DRAWINGS

The foregoing summary, as well as the following detailed description of the invention, is better understood when read in conjunction with the appended drawing. For the purpose of illustrating the invention, exemplary constructions of the invention are shown in the drawings. However, the invention is not limited to the specific methods and instrumentalities disclosed herein.

DETAILED DESCRIPTION OF EXEMPLARY EMBODIMENTS

Figure 1:
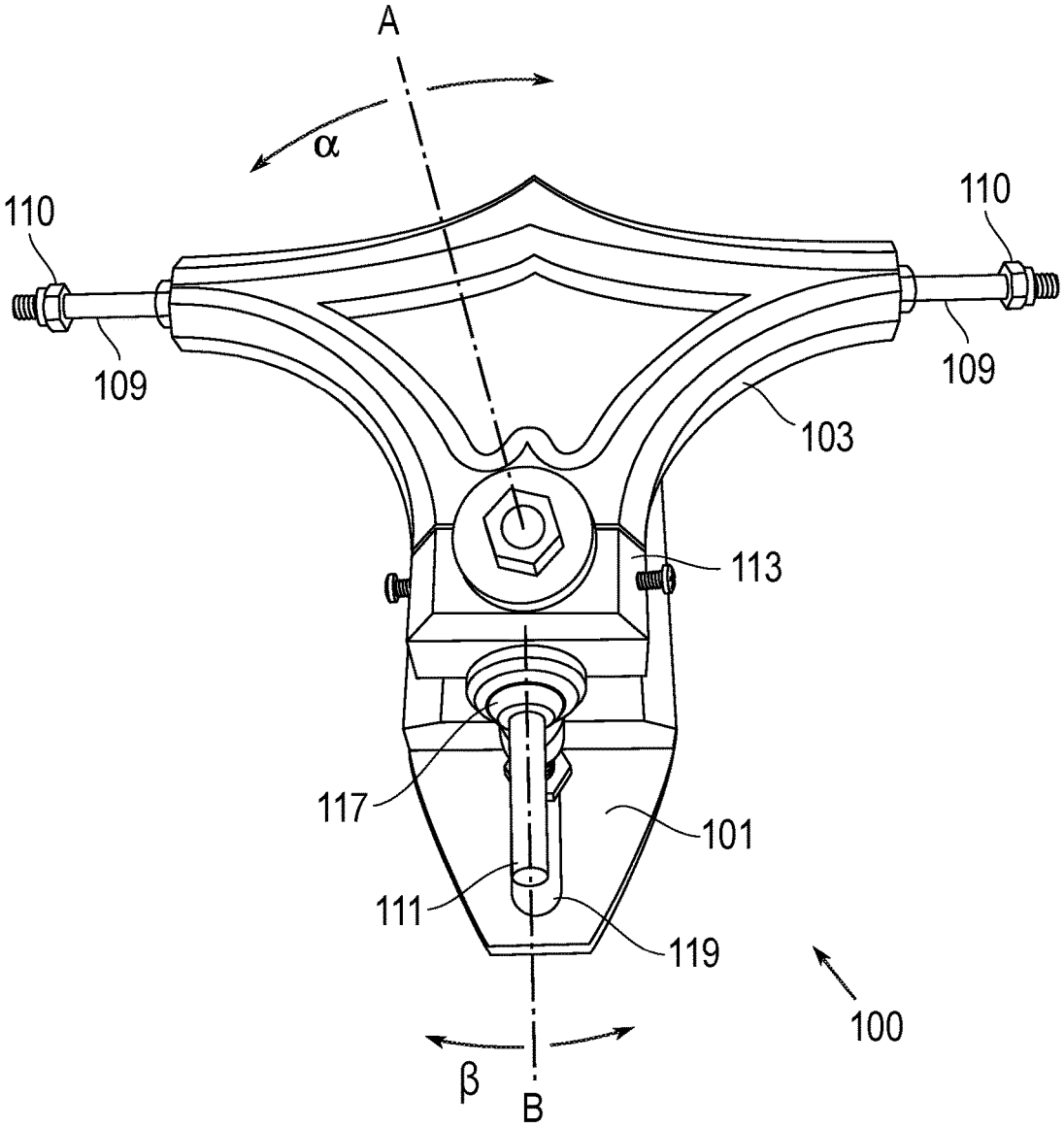
FIG. 1 illustrates a perspective top view of the main embodiment of the present invention.
Figure 2:
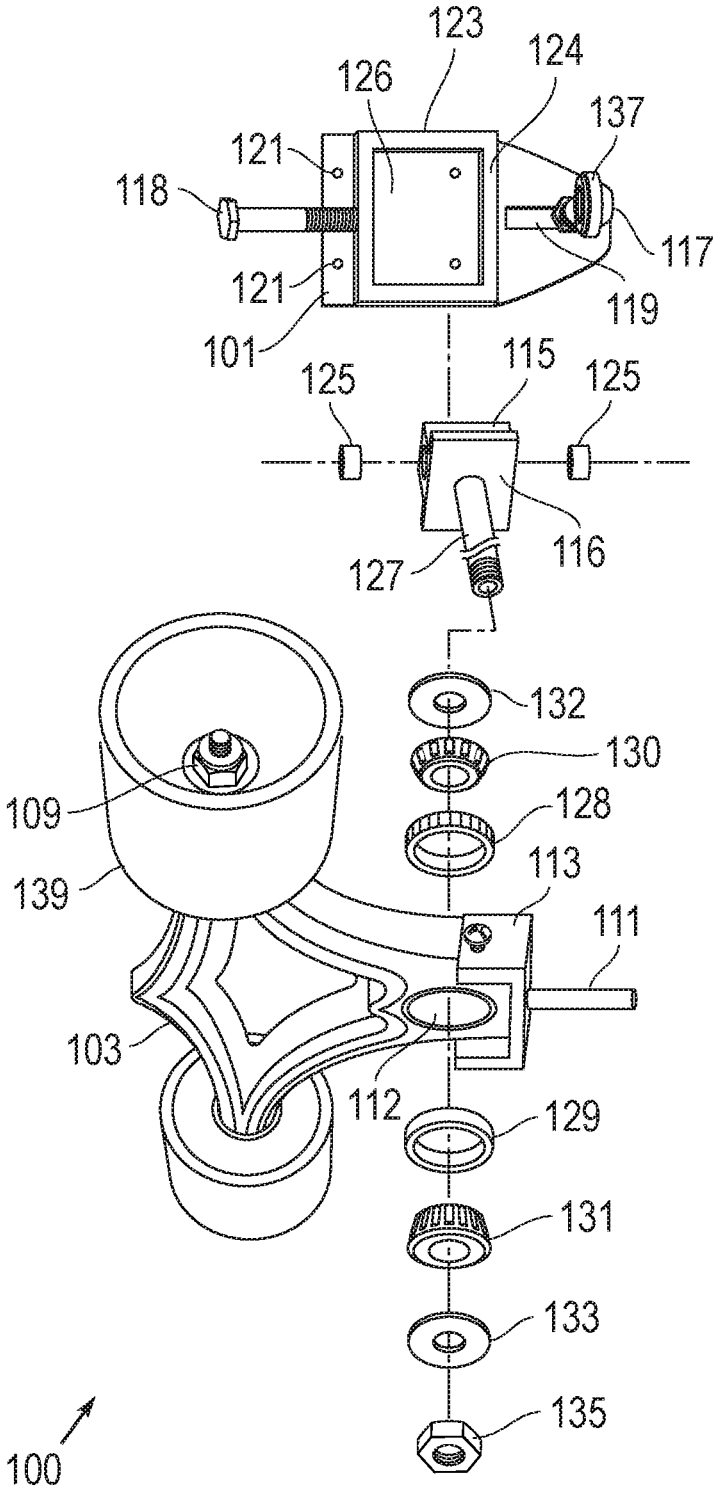
FIG. 2 illustrates an exploded view of the main embodiment of the present invention.

With reference to the figures, where like elements have been given like numerical designations to facilitate the reader's understanding of the present invention, the preferred embodiments of the present invention are set forth below. The enclosed figures and drawings are merely illustrative of one or more of the preferred embodiments and, as such, represent one or more ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain configurations for the skateboard truck assembly of the present invention, a skateboard utilizing such truck assembly and wheels mounted to the truck assembly, those who are skilled in the art will readily understand that this is merely for purposes of simplifying the present disclosure and that the present invention is not so limited.

The preferred embodiment of the present invention is illustrated in FIGS. 1-7. As depicted in FIGS. 1-6, the truck 100 is comprised of a base plate 101, a hanger 103, a first pivot assembly, and a second pivot assembly. Attached to the hanger 103 are one or more axles 109. The axels 109 or axel may be offset. One or more wheels 139 are connected to the axels 109 and are secured with a lock nut 110. On the pivot end of the hangar, opposite from the axels 109, is a first pivot opening 112. Attached to the pivot end of the hangar 103 is a steering shaft 111. The steering shaft 111 includes an attachment flange 113 which is mechanically fastened to the hanger 103 in a way that allows the steering shaft 111 to move along one axis relative to the hangar 103. In the exemplary embodiment pictured, the attachment flange 113 is mechanically attached to the hanger 103 using threaded screws.

The hanger 103 is connected to the first pivot assembly through the opening 112. The first pivot assembly includes the base plate 101, the first pivot hub 115, the first pivot shaft 118, the stability pads 141, the wedge pad 143, and the bearing assembly. The bearing assembly is comprised of several parts including washers 132, 133, tapered roller bearings 130, 131, roller bearing cups 128, 129 and a lock nut 135. During assembly, the first pivot shaft 118 is inserted into an opening in the elevated sidewall 124, then into a first bearing 125, into an axial opening in the first pivot hub 115, then into a second bearing 125 and terminating at a second elevated wall 124. This places the first pivot hub into the cavity 126. The first pivot hub 115 has a hub shaft 127 which is inserted through the washer 132, roller bearing 130, roller bearing cup 128, the hanger opening 112, roller bearing cup 129, roller bearing 131, washer 133 and finally through a lock nut 135. The first pivot assembly secures the hanger 103 to the base plate 101 which is secured to the skateboard. The first bearing assembly allows the pivot hub 115 and shaft 127 (axis A in FIG. 1) to rotate relative to the first pivot point created by the first pivot assembly. The degree of rotation of the shaft (a in FIG. 1) is plus or minus 50° degrees relative to the non-flexed position.

The base plate 101 has one or more screw slots 121 to receive screws that secure the truck 100 to the skateboard deck. The base plate 101 includes a housing 123 that includes a plurality of elevated sidewalls 124 forming a cavity 126 for retaining the first pivot hub 115, the stability pads 141 (see FIG. 3), and the wedge pad 143 (FIG. 4). One or more of the elevated sidewalls 124 include circular openings for receiving the first pivot shaft 118, and any screws 145. The shaft 127 and first pivot hub 115 may be formed as one piece or fastened together by threaded mating party, welding, or similar means.

As described above, the first pivot shaft 118 is inserted into the circular openings in the walls 124 and into the first pivot hub 115 to secure the first pivot hub 115 to the base plate 101. In an exemplary embodiment, the base plate 101 is configured to hold the first pivot hub 115 at an angle relative to the skateboard deck. In the exemplary embodiment, the angle would be at, close to, or approximately twelve degrees. However, the angle could be lower or higher than twelve degrees.

The truck 100 also includes a second pivot point through a second pivot assembly. The second pivot assembly includes a pivot pin 137, a steering shaft 111, and an eyeball bearing 138. The base plate 101 contains a secondary pivot point adjustment slot 119. This secondary pivot point adjustment slot 119 allows for the attachment of the secondary pivot pin 137 to the base plate 101. This secondary pivot pin 137 can be adjusted horizontally along the adjustment slot 119 to modify the distance between the secondary pivot assembly and the first pivot assembly. The base plate 101 also contains a recess so that nut securing the secondary pivot pin 137 can sit flush with the base plate 101. The secondary pivot pin 137 includes an eyelet 117 that can be raised or lowered along the pivot pin 137 shaft to further modify the variable turning radius of the steering shaft 111. The steering shaft 111 is threaded through the eyeball bearing 138 and into the secondary pivot point eyelet 117 of the pivot pin 137. The steering shaft 111 has an attachment flange 113 which is attached to the hanger 103 in a hinged configuration.

Figure 3:
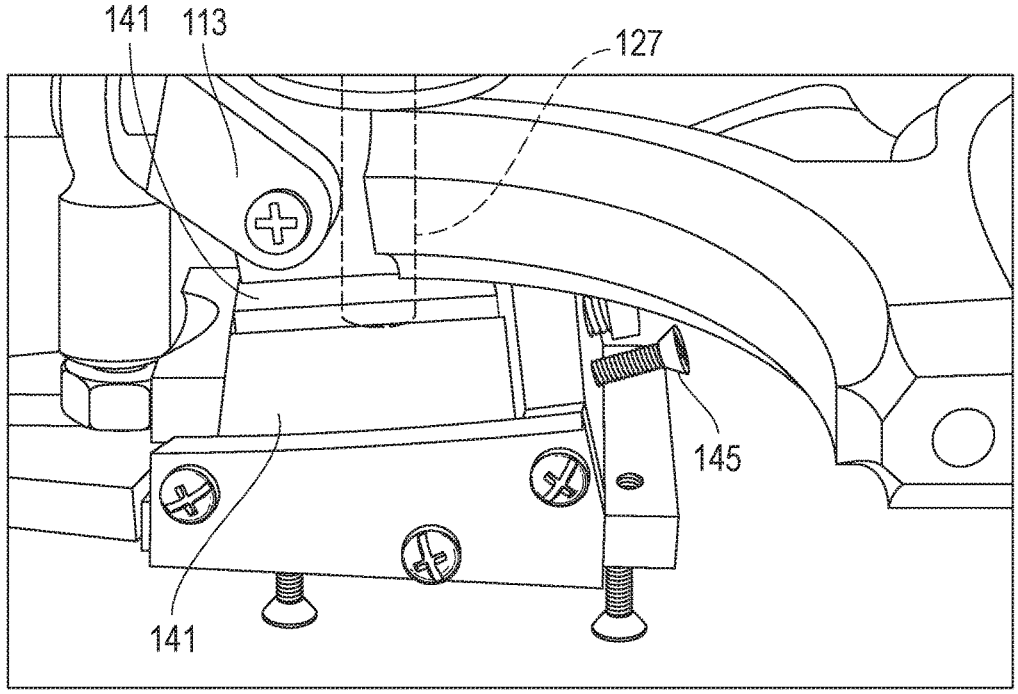
FIG. 3 illustrates a cross-sectional view of the present invention's first pivot hub.
Figure 4:
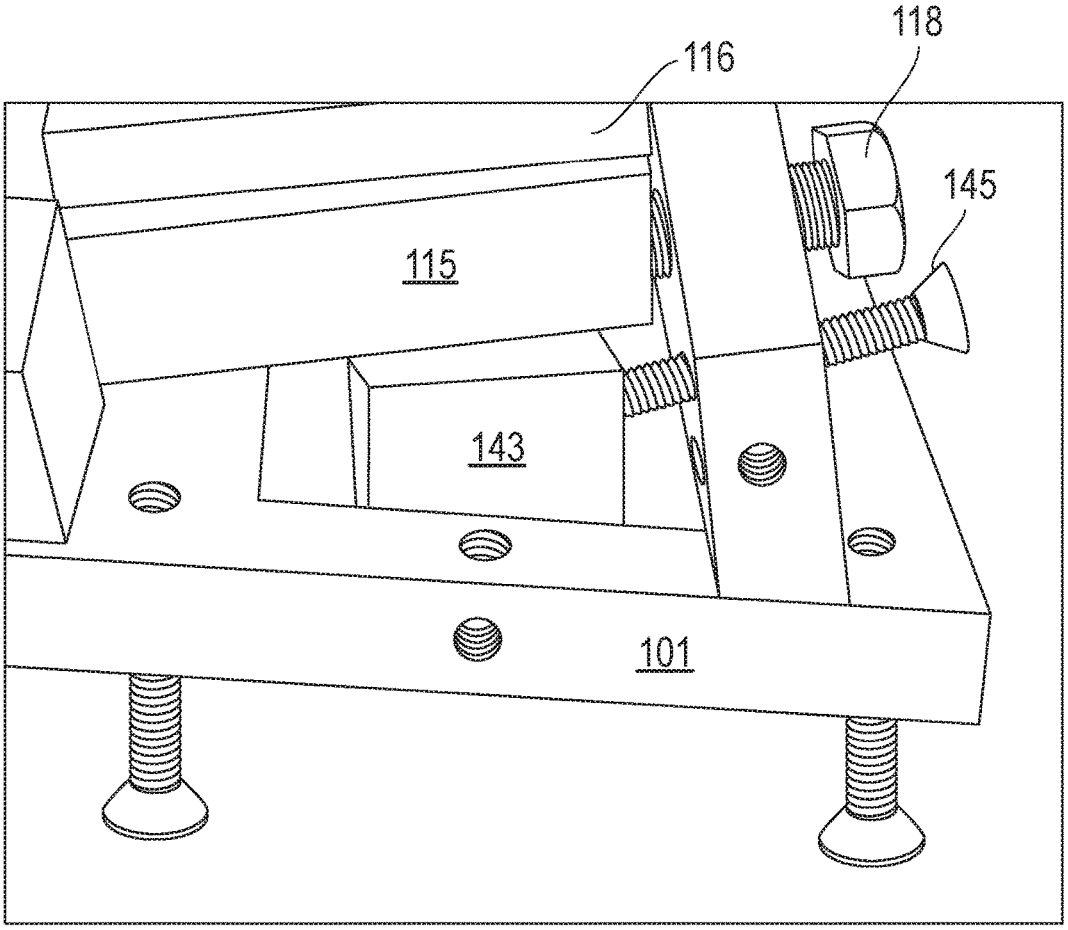
FIG. 4 illustrates a cross-sectional view of the present invention's first pivot hub with the side stabilizing pads removed.

As shown in FIGS. 3-4, the preferred embodiment of the present invention also includes side stabilizing pads 141 and an adjustable stabilizing wedge pad 143. In the preferred embodiment of the present invention, the side stabilizing pads 141 are made out of rubber and the adjustable wedge pad 143 is made out of urethane. Alternative embodiments may utilize other materials such as hard urethane (100% urethane), soft or foam like urethane, or other suitable material. The design may also incorporate springs or other mechanical tension configurations.

As shown in FIG. 3, two side rubber stabilizing pads 141 (one on either side of the shaft 127) are positioned to push against the top lip 116 of the first pivot hub 115. As shown in FIG. 4, a wedge pad 143 resides or is placed under the pivot hub 115. The wedge pad 143 is ideally a urethane stabilizing pad located between the base plate 101 and the bottom of the first pivot hub 115. One or more screws 145 are threaded through the base plate wall to push or pull the wedge pad 143 within the cavity 126. The wedge pad 143 has a wedge shape which when pushed further into the cavity 126 reduces the space the pivot hub 115 has to move.

Further, the pivot hub 115 has to directly contend with the resistance of the wedge pad 143. By tightening or lessening the screw 145, the wedge pad 143 is pushed into the decreasing space under the first pivot hub 115 to tighten the pad and further increase the truck's stability. In other words, when the screw 145 is tightened, bias pressure is being added onto the pad 143 resulting in less space for the first pivot hub 115 to flex.

Figure 5:
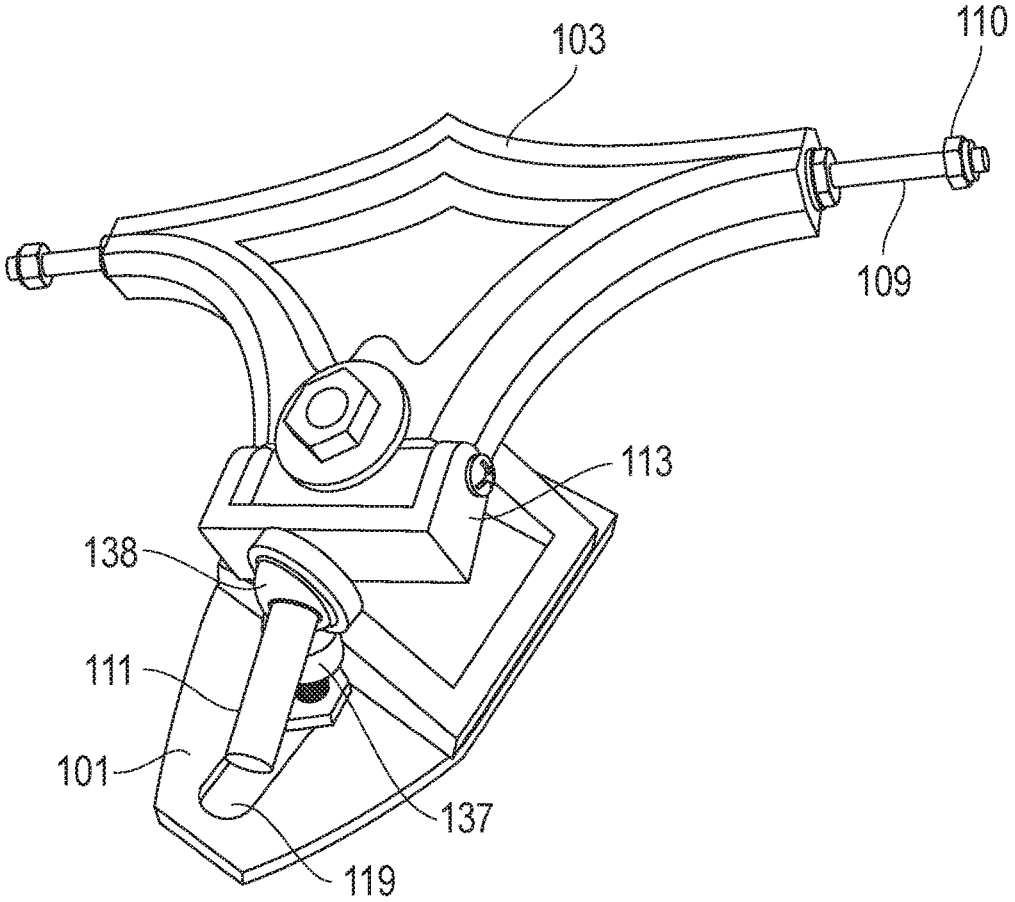
FIG. 5 illustrates a perspective view of the main embodiment of the present invention with the adjustable second pivot assembly eyelet is positioned close to the first pivot assembly.
Figure 6:
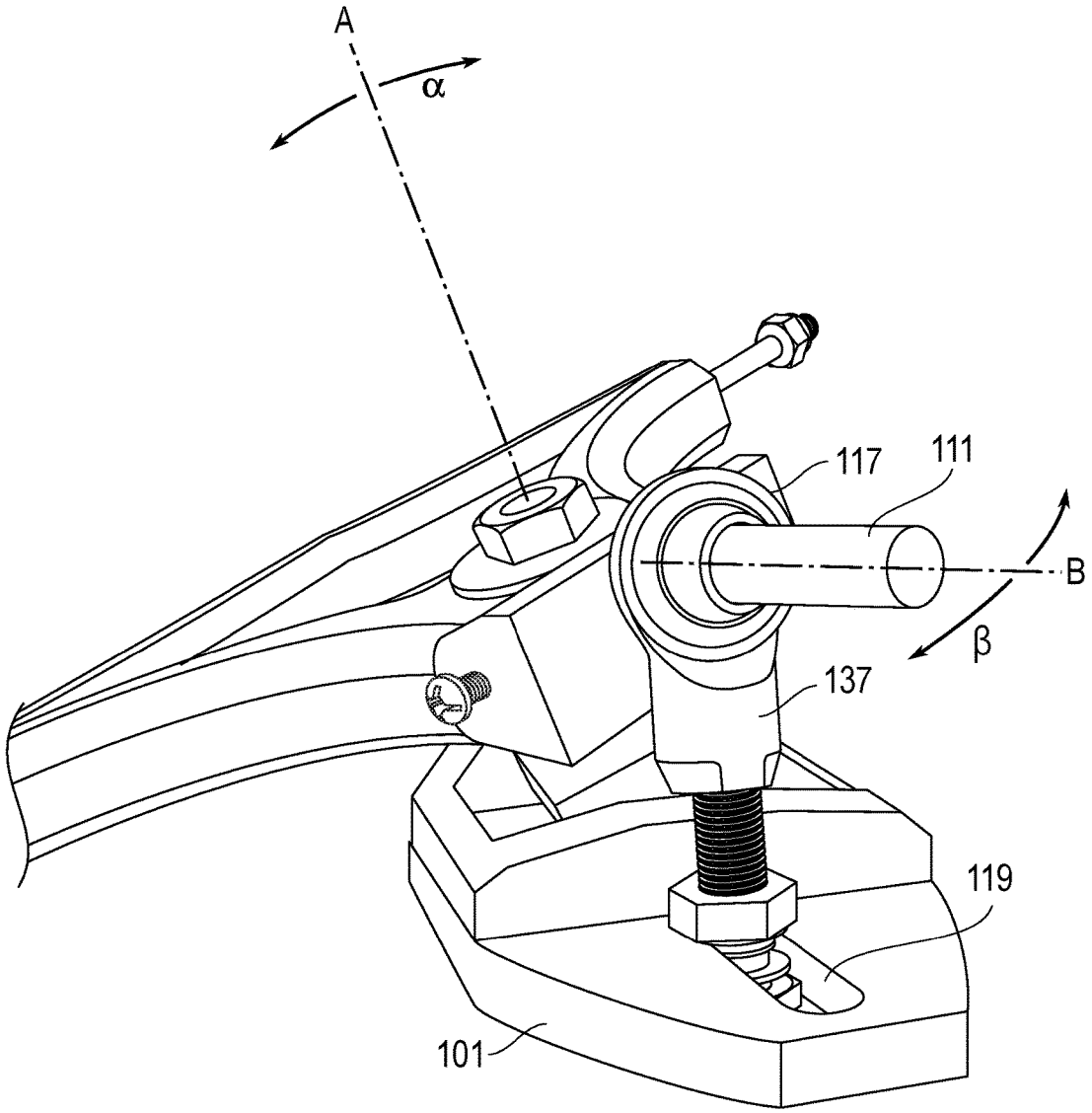
FIG. 6 illustrates an alternative perspective view of the main embodiment of the present invention where the adjustable second pivot assembly eyelet is fully extended.

FIGS. 5 and 6 illustrate the adjustable secondary pivot assembly. As previously described, the secondary pivot assembly includes a pivot pin 137, a steering shaft 111, and an eyeball bearing 138. The pivot pin 137 is mechanically fastened to the base plate 101 by one or more threaded fasteners or nuts. The pivot pin 137 may be moved along the slot 119 to adjust the pivot point of the second pivot assembly. The closer the pivot pin 137 is (along the slot 119) to the first pivot assembly the truck 100 and board achieves a tighter deck turning radius allowing the skateboard rider to quickly turn the direction of the deck. As the pivot pin 137 is moved away from the first pivot assembly along the horizontal secondary pivot point adjustment slot 119, the variable turning radius would provide a slower and wider turn.

The pivot pin 137 has a threaded eyelet 117 which can rotate along the threaded shaft connected to the base plate 101 to increase or decrease the height of the eyelet 117 relative to the base plate 101. The height adjustment also helps to increase or decrease the rotation of the hanger 103 with tighter turning ratios coming when the eyelet 117 is at its near its maximum height. The steering shaft 111 is inserted into an eyeball socket or bearing 138 and into the eyelet opening 117. The steering shaft 111 rotates about the pivot point created by the pivot pin 137 along the B axis. The rotation (13) of the steering pin 111 relative to the pivot pin 137 is plus or minus 40° degrees from neutral for a total of an 80° degree rotational movement. This rotation (13) is important for movement of the hanger 103 and axels 109 during turns.

The ability of the first pivot assembly to rotate plus or minus 50° degrees and the second pivot assembly to rotate plus or minus 40° degrees enables the hanger 103 and axels 109 to move significantly relative to the longitudinal axis of the board. For comparison, a standard skateboard truck under flex from a rider might cause the truck axel axis (generally perpendicular to the longitudinal axis of the board) to rotate plus or minus 20° degrees from the normal non-flexed axel axis. By comparison, the dual pivot assembly of the present invention allows the axel axis to rotate plus or minus 50° degrees from the non-flexed axel axis position. The increased axel rotation enables greater turning options.

Figure 7A:
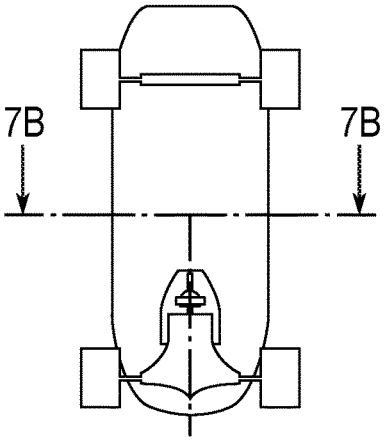
FIGS. 7A-7F illustrates the movement of the truck from the non-flexed position to a heavily flexed position.
Figure 7B:
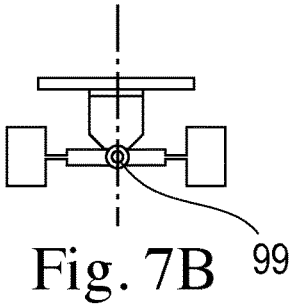
Figure 7C:
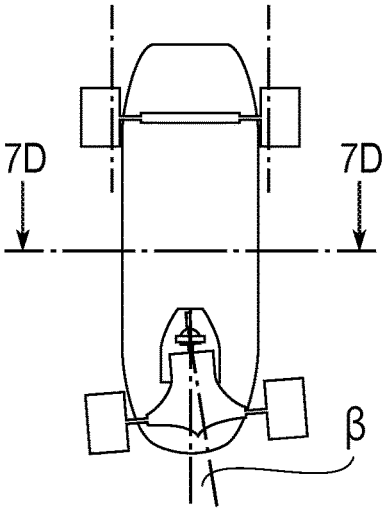
Figure 7D:
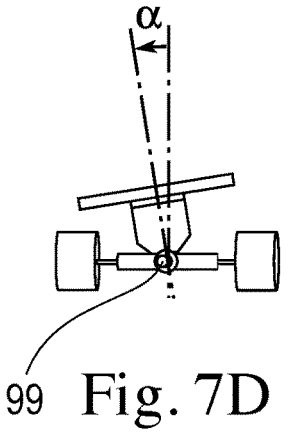
Figure 7E:
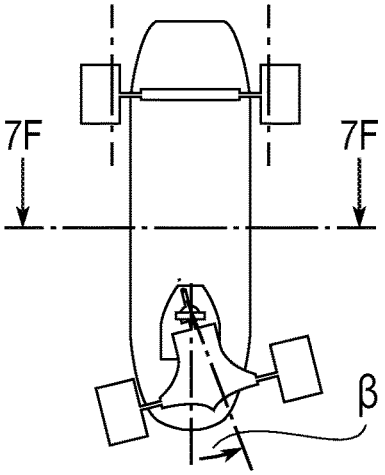
Figure 7F:
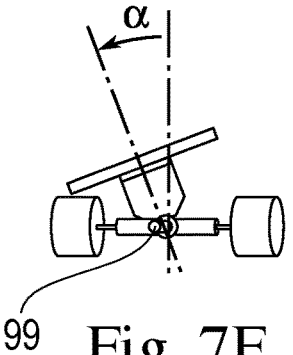

However, another important aspect of the present invention is that during these extended rotational turns, the truck 100 design shifts the axel midpoint toward the direction of the turn or weight of the user. This axel midpoint shift increases the stability of the board during turns. As seen in FIGS. 7A-7F, the axel midpoint 99 shifts relative to the starting position or un-flexed position. The skateboards in FIGS. 7A-7B depict a truck 100 of the present invention on the front of the deck only. However, the truck 100 of the present invention could be used as the front and back truck. FIGS. 7A, 7C, and 7E illustrated the underside of the skateboard while FIGS. 7B, 7D, and 7F show the front the skateboard.

FIGS. 7A and 7B show the skateboard and truck in a non-flexed position. The axel midpoint 99 is positioned directly along the longitudinal axis of the board. FIGS. 7C and 7D show the skateboard and truck in a partially flexed position. The flex or weight causes the first pivot assembly to rotate α degrees (FIG. 7D) out from the vertical axis while the second pivot assembly causes the hanger 103 to rotate β degrees (FIG. 7C) out of the longitudinal axis. As seen in FIG. 7D, the axel midpoint 99 has shifted in the direction of the turn.

Figures E and 7F show the skateboard and truck in a heavily flexed position. The flex or weight causes the first pivot assembly to rotate α degrees (FIG. 7F) out from the vertical axis while the second pivot assembly causes the hanger 103 to rotate β degrees (FIG. 7E) out of the longitudinal axis. As seen in FIG. 7F, the axel midpoint 99 has shifted significantly in the direction of the turn.

For comparison, a standard skateboard truck might see movement of the axel midpoint during a turn move plus or minus ¼ of an inch relative to the longitudinal axis. In contrast, the dual pivot assembly design of the present invention enables the axel midpoint during a turn to move plus or minus 2 inches relative to the longitudinal axis. This significantly greater axel midpoint movement helps to keep the center of the truck under the center of gravity of the rider making the skateboard more stable. The axel midpoint for a single axel design would be the midpoint of the single axel. The axel midpoint for a hanger design which uses a left and right axel would be the midpoint as if the two axels were connected as one or the midpoint of the axis through the two axels. Although the design depicted in the images shows a hanger 103 with two axels 109, the system could use a single axel design without deviating from the scope of the invention.

The present invention also includes an offset axle or axels 109 that may extend beyond the width of the skateboard deck. This offset axle 109 allows for the wheels 139 to move in the direction the rider is leaning. For example, if the rider shifts his weight to the right intending for the skateboard to make a right turn, the right front wheel moves behind the left front wheel (axel rotation) and the right back wheel moves in front of the left back wheel. At the same time, the entire axle assembly moves to the right moving the midpoint 99 toward the weight of the rider. By swinging the axle and wheels towards the direction of the turn, the wheels are shifted away (more to the right) from the side of the skateboard and eliminating or reducing wheel bite.

The offset axle 109 configuration also provides additional stability to the skateboard. When shifting the rider's weight to one side of the board, the shifted axel midpoint or truck center of gravity helps to offset the shifted center of gravity of the rider. Since the truck is configured with two pivot assemblies, the axle 109 and wheels 139 move in the direction the rider is leaning allowing the center of gravity of the truck to remain under the rider giving him much more stability while turning the skateboard.

The foregoing examples have been provided merely for the purpose of explanation and are in no way to be construed as limiting of the present method and product disclosed herein. While the invention has been described with reference to various embodiments, it is understood that the words which have been used herein are words of description and illustration, rather than words of limitation. Further, although the invention has been described herein with reference to particular means, materials, and embodiments, the invention is not intended to be limited to the particulars disclosed herein; rather, the invention expands to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

We claim:

1. A skateboard truck assembly comprising:

a skateboard deck base plate;

a first pivot hub connected to the base plate, wherein the first pivot hub includes a hub shaft;

a hanger connected to the hub shaft;

a steering shaft connected to the hanger by an attachment flange configured to allow the steering shaft to pivot relative to the hangar along one axis;

a pivot pin having a base end connected to the base plate and a top end connected to the steering shaft;

wherein the hangar moves in a first axis relative to the pivot pin and in a second axis relative to the first pivot shaft; and one or more axles supported by the hanger.

2. The skateboard truck assembly of claim 1, the top end of the pivot pin including a bearing assembly to allow movement of the pivot pin relative to the steering shaft.

3. The skateboard truck assembly of claim 2, the bearing assembly constructed to allow three-dimensional movement of the base plate relative to the steering shaft.

4. The skateboard truck assembly of claim 2, the bearing assembly constituted by an eyeball socket to allow three-dimensional movement of the base plate relative to the steering shaft.

5. A skateboard truck assembly comprising:

a skateboard deck base plate;

a first pivot hub connected to the base plate, wherein the first pivot hub includes a hub shaft;

a hanger connected to the hub shaft;

a steering shaft connected to the hanger by an attachment flange configured to allow the steering shaft to pivot relative to the hangar along one axis;

a pivot pin having a base end connected to the base plate and a top end connected to the steering shaft;

wherein the hangar moves relative to the pivot pin, the steering shaft, and the first pivot shaft; and one or more axles supported by the hanger.

6. A skateboard truck assembly comprising:

a skateboard deck base plate;

a first pivot hub connected to the base plate, wherein the first pivot hub includes a hub shaft;

a hanger connected to the hub shaft;

a steering shaft connected to the hanger by an attachment flange configured to allow the steering shaft to pivot relative to the hangar along one axis;

a pivot pin having a base end connected to the base plate and a top end connected to the steering shaft, and the top end of the pivot pin including a bearing assembly to allow movement of the pivot pin relative to the steering shaft;

wherein the hangar moves in a first axis relative to the pivot pin and in a second axis relative to the first pivot shaft; and one or more axles supported by the hanger.

7. The skateboard truck assembly of claim 6, the bearing assembly constructed to allow three-dimensional movement of the base plate relative to the steering shaft.

8. The skateboard truck assembly of claim 6, the bearing assembly constituted by an eyeball socket to allow three-dimensional movement of the base plate relative to the steering shaft.

* * * * *